US008339354B2

(12) United States Patent
Kwisthout et al.

(10) Patent No.: US 8,339,354 B2
(45) Date of Patent: Dec. 25, 2012

(54) SYSTEM, METHOD, AND COMPUTER-READABLE MEDIUM FOR DISPLAYING LIGHT RADIATION

(75) Inventors: Cornelis Wilhelmus Kwisthout, Eindhoven (NL); Guido Galeazzi, Eindhoven (NL)

(73) Assignee: TP Vision Holding B.V., Eindhoven (NL)

( * ) Notice: Subject to any disclaimer, the term of this patent is extended or adjusted under 35 U.S.C. 154(b) by 667 days.

(21) Appl. No.: 12/524,379

(22) PCT Filed: Jan. 21, 2008

(86) PCT No.: PCT/IB2008/050199

§ 371 (c)(1),
(2), (4) Date: Jul. 24, 2009

(87) PCT Pub. No.: WO2008/090506

PCT Pub. Date: Jul. 31, 2008

(65) Prior Publication Data

US 2009/0322801 A1 Dec. 31, 2009

(30) Foreign Application Priority Data

Jan. 26, 2007 (EP) ..... 07101262

(51) Int. Cl.
*G09G 3/36* (2006.01)

(52) U.S. Cl. ..... 345/102; 345/204; 345/207; 345/77; 345/690; 345/604; 362/97.1

(58) Field of Classification Search ..... 345/55, 345/60, 76, 77, 84, 87, 88, 102, 204, 690, 345/207, 82, 83, 604; 348/578, 581, 739; 362/97.1, 97.2, 97.3
See application file for complete search history.

(56) References Cited

U.S. PATENT DOCUMENTS

| | | | | |
|---|---|---|---|---|
| 7,180,529 | B2 * | 2/2007 | Covannon et al. | 345/690 |
| 7,864,204 | B2 * | 1/2011 | Overes | 345/102 |
| 2003/0146919 | A1 | 8/2003 | Kawashima et al. | |
| 2006/0062424 | A1 | 3/2006 | Diederiks et al. | |
| 2007/0126864 | A1 * | 6/2007 | Bhat et al. | 348/51 |
| 2007/0126932 | A1 * | 6/2007 | Bhat et al. | 348/578 |
| 2007/0164975 | A1 * | 7/2007 | Lim et al. | 345/102 |

FOREIGN PATENT DOCUMENTS

| | | | |
|---|---|---|---|
| EP | 1551178 | A1 | 7/2005 |
| EP | 1569195 | A2 | 8/2005 |
| GB | 2416029 | A | 1/2006 |
| JP | 2001147664 | A | 5/2001 |
| WO | 2006025190 | A1 | 3/2006 |

OTHER PUBLICATIONS

Rafke, P: "Ambilight for PC, Part 1"; Downloaded From http://divxstation.com/article.asp?ald=151 on Sep. 29, 2006, 9 page document.

* cited by examiner

*Primary Examiner* — Lun-Yi Lao
*Assistant Examiner* — Tom Sheng
(74) *Attorney, Agent, or Firm* — Shimokaji & Assoc, PC

(57) ABSTRACT

A display system providing an enhanced viewing experience is provided. The system enables having backlighting colors fast adapted to the screen content while at the same time also having a relaxed viewing experience because the luminance slowly changes over time. A method and a computer-readable medium are also provided.

16 Claims, 4 Drawing Sheets

SYSTEM, METHOD, AND COMPUTER-READABLE MEDIUM FOR DISPLAYING LIGHT RADIATION

FIELD OF THE INVENTION

This invention pertains in general to a visual display system suitable for including with or adding to display devices, such as television sets. Moreover, the invention relates to a method and computer-readable medium for operating such visual display system.

BACKGROUND OF THE INVENTION

Visual display devices are well known and include cinematic film projectors, television sets, monitors, plasma displays, liquid crystal display LCD televisions, monitors, and projectors etc. Such devices are often employed to present images or image sequences to viewer.

The field of backlighting began in the 1960s due to the fact that televisions require a "darker" room for optimal viewing. Backlighting is in its simplest form white light, emitted from e.g. a light bulb, projected on a surface behind the visual display device. Backlighting has been suggested to be used to relax the iris and reduce eye strain.

During recent years the backlighting technology has become more sophisticated and there are several display devices on the market with integrated backlighting features that enables emitting colors with different brightness depending on the visual information presented on the display device.

The benefits of backlighting in general includes: a deeper and more immersive viewing experience, improved color, contrast and detail for best picture quality, and reduced eye strain for more relaxed viewing. Different advantages of backlighting require different settings of the backlighting system. Reduced eye strain may require slow changing colors and a more or less fixed brightness while more immersive viewing experience may require an extension of the screen content i.e. the same brightness changes with the same speed as the screen content.

It is currently desired to create backlighting systems providing both relaxing viewing and immersive viewing experience. However, there is a conflict between both requirements for the current visual display systems as to make both an extension of the screen by means of a fast color responding system and a slow brightness responding system for relaxed viewing for the eyes.

A disadvantage of the current relaxed backlighting setting is that besides the brightness also the color information changes slowly over time. This results in much less correlation between the current backlighting effect and the current scene in the presented image content. As an example, when a scene changes from red to blue, the current backlighting solutions result in a relative long time with purple backlighting colors while they were never in the scene.

Hence, an improved visual display system, method, and computer readable medium would be advantageous.

SUMMARY OF THE INVENTION

Accordingly, the present invention preferably seeks to mitigate, alleviate or eliminate one or more of the above-identified deficiencies in the art and disadvantages singly or in any combination and solves at least the above-mentioned problems by providing a system, method and a computer-readable medium according to the appended patent claims.

According to one aspect of the invention, a system is provided. The system comprises a monitor unit configured to monitor an information signal comprising luminance and chrominance information, and generate a first signal, a first conversion unit configured to convert the luminance information of the first signal to a separate luminance information component, and chrominance information of the first signal to a separate chrominance information component, and a control unit configured to control: a first reaction time of an illumination area, the illumination area being capable of emitting light radiation, wherein the first reaction time is defined for the separate luminance information component; a second reaction time of the illumination area, wherein the second reaction time is defined for the separate chrominance information component; and light radiation emitted from each illumination area in the system in response to the luminance information component and the first reaction time, and the chrominance information and the second reaction time.

According to another aspect of the invention, a method is provided. The method comprises monitoring an information signal comprising luminance and chrominance information, and generating a first signal, converting the luminance information of the first signal to a separate luminance information component, and chrominance information of the first signal to a separate chrominance information component, and controlling: a first reaction time of an illumination area, the illumination area being capable of emitting light radiation, wherein the first reaction time is defined for the separate luminance information component; a second reaction time of the illumination area, wherein the second reaction time is defined for the separate chrominance information component; and light radiation emitted from each illumination area in response to the luminance information component and the first reaction time, and the chrominance information and the second reaction time.

According to yet another aspect of the invention, a computer-readable medium having embodied thereon a computer program for processing by a processor is provided. The computer program comprises a monitor code segment configured to monitor an information signal comprising luminance and chrominance information, and generate a first signal, a conversion code segment configured to convert the luminance information of the first signal to a separate luminance information component, and chrominance information of the first signal to a separate chrominance information component, and a control code segment configured to control: a first reaction time of an illumination area, the illumination area being capable of emitting light radiation, wherein the first reaction time is defined for the separate luminance information component; a second reaction time of the illumination area, wherein the second reaction time is defined for the separate chrominance information component; and light radiation emitted from each illumination area in response to the luminance information component and the first reaction time, and the chrominance information and the second reaction time.

An objective according to some embodiments of the present invention is to create an enhanced viewing experience by having the backlighting colors better adapted to the screen content while at the same time also having a relaxed viewing experience because the brightness slowly changes over time.

Embodiments of the present invention combines both extremes to provide both sensations to the user simultaneously using a parameter denoted as "reaction time", also called "integration time", "rise/fall time" etc. This parameter defines how long a color that is not anymore present in the screen content should still remain in the current backlighting effect and how fast a new color should be dominant in the backlighting effect.

A main feature of some embodiments of the present invention is to utilize different reaction times separately for the brightness, also commonly referred to as luminance, and color, also commonly referred to as chrominance, information. When e.g. using the YUV color space this in practice corresponds to integrating the Y component of YUV signal separately from the UV components of the YUV signal, specifically for the relaxed backlighting modes.

The present invention according to some embodiments allows for increased performance, flexibility, cost effectiveness, deeper and more immersive viewing experience, and reduced eye strain for more relaxed viewing.

BRIEF DESCRIPTION OF THE DRAWINGS

These and other aspects, features and advantages of which the invention is capable of will be apparent and elucidated from the following description of embodiments of the present invention, reference being made to the accompanying drawings figures, in which.

DESCRIPTION OF EMBODIMENTS

Figure 1:
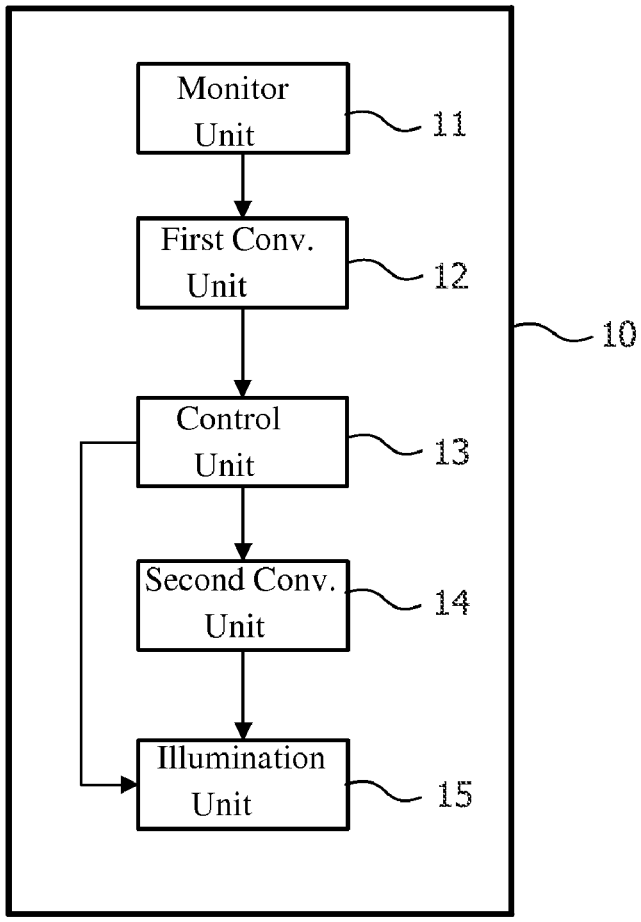
FIG. 1 is a block diagram of a system according to an embodiment.

Several embodiments of the present invention will be described in more detail below with reference to the accompanying drawings in order for those skilled in the art to be able to carry out the invention. The invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments do not limit the invention, but the invention is only limited by the appended patent claims. Furthermore, the terminology used in the detailed description of the particular embodiments illustrated in the accompanying drawings is not intended to be limiting of the invention.

The following description focuses on embodiments of the present invention applicable to backlighting of visual display devices, such as cinematic film projectors, television sets, monitors, plasma displays, liquid crystal display LCD televisions, projectors etc. However, it will be appreciated that the invention is not limited to this application but may be applied to many other areas in which backlighting is desired.

In some embodiments the present invention provides a system capable of controlling the reaction time of a backlighting segment, hereinafter referred to as illumination area, according to changes of the presented image content. This is done using two parameters: integrator rise time and fall time. The integrator rise time parameter defines how rapid new color information should influence the current backlighting color while the fall time parameter defines how long it should take until the old color information is faded out of the current backlighting color. Both the integrator rise time and fall time parameters currently work on RGB values.

The present invention provides a solution of smoothing the backlighting effect in order to make the backlight a peaceful continuation of the screen while still being able to rapidly respond to colors in the presented image content.

The present invention according to some embodiments provides a display system that enables utilizing different reaction times separately for luminance (e.g. Y) and chrominance (e.g. UV) information. In this way the viewing experience may remain relaxed (slow changes in luminance) while still enjoying the full color or chrominance range. In a practical implementation the Y parameter, or luminance, may be kept slowly responding to the content while the UV parameter, or chrominance, could react very quickly. In this way backlighting may still be relaxing for the eyes while the color correlation with the current scene is maintained.

An idea of some embodiments of the invention is to process the reaction time in the YUV domain, wherein luminance, also commonly referred to as brightness, and chrominance, also referred to as color, information are separated instead of the RGB domain, in which the luminance and chrominance information are combined in the three components R, G, and B. The chrominance information should then be very responsive to the screen content (short rise and fall times) while the luminance information should be kept more stable over time (maybe even almost constant) so these are less responsive to the presented screen content (long rise and fall times). However, the present invention is not limited to the use of the YUV color space, but may be any color space that has luminance information separated from chrominance information, such as the commonly known color spaces Yu'v' or Yxy. The YUV color space is defined by one luminance and two chrominance components. YUV is used in the analog variant of the PAL system of television broadcasting, which is the standard in much of the world. YUV models human perception of color more closely than the standard RGB model used in computer graphics hardware. Y stands for the luminance component and U and V are the chrominance components.

In an embodiment, a display system 10, according to FIG. 1, is provided. The system comprises a monitor unit (11) configured to monitor an information signal comprising luminance and chrominance information, and generate a first signal. Moreover, the system comprises a first conversion unit (12) configured to convert the luminance information of the first signal to a separate luminance information component, and chrominance information of the first signal to a separate chrominance information component. Furthermore, the system comprises a control unit (13) configured to control a first reaction time of an illumination area (15), the illumination area being capable of emitting light radiation, wherein the first reaction time is defined for the separate luminance information component. The control unit is further configured to control a second reaction time of the illumination area (15), wherein the second reaction time is defined for the separate chrominance information component. The control unit is moreover configured to control light radiation emitted from each illumination area (15) of the system in response to the luminance information component and the first reaction time, and the chrominance information and the second reaction time.

In some embodiments the system further comprises a second conversion unit 14 for converting the separate luminance information component for each illumination area based on the first reaction time, and the separate chrominance information component for each illumination area based on the second reaction time to combined luminance and chrominance information, such as RGB information, generating a second signal. The control unit is in this embodiment configured to control light radiation emitted from each illumination area 15 in response to the second signal.

An advantage of this embodiment is that the system enhances the viewing experience by having the backlighting colors better adapted to the screen content while at the same time also providing a relaxed viewing experience because the luminance of the illumination areas slowly changes over time.

Image Dataset

In an embodiment the information signal comprises an image sequence. In other embodiments the information signal is a video signal.

In an embodiment the information signal is based on the RGB (red, green, blue) color space. In the RGB color space the chrominance and luminance information are combined, meaning that the all of the three components, R, G, and B comprise both luminance and chrominance information, and to separate the chrominance information from the luminance information a conversion has to be made, e.g. by using the first conversion unit of the system.

In another embodiment the information signal is based on the YUV color space. In the YUV color space the luminance (Y) and chrominance (UV) information is separated and hence, in this embodiment, the first signal already comprise separated luminance and chrominance information components and hence the first conversion unit does not convert the first signal but merely forward the first signal to the control unit for further processing. The term a or the "separate chrominance component" used throughout the specification may refer to a plurality of "separate chrominance components" such as U and V in the YUV color space.

Illumination Area

In an embodiment the illumination area comprises at least one source of illumination and one input for receiving a signal, e.g. from the control unit, that controls the luminance or chrominance of the illumination source. The illumination area is according to some embodiments of the invention used as a backlighting source to provide the backlight.

In some embodiments the input for receiving a signal is adapted for the RGB color space.

The illumination source may e.g. be a light emitting diode, LED, for emitting light based on the image content on the display device. The LED is a semiconductor device that emits incoherent narrow-spectrum light when electrically biased in the forward direction. The color of the emitted light depends on the composition and condition of the semiconducting material used, and may be near-ultraviolet, visible or infrared. By combination of several LEDs, and by varying the input current to each LED, a light spectrum ranging from near-ultraviolet to infrared wavelengths may be presented.

The present invention is not limited to what kind of illumination source that is used to create the backlighting effect. Any source capable of emitting light may be used.

In an embodiment the display device and the illumination area may be comprised in a projector that in use projects an image on an area on a surface, such as a wall. The projected image comprises a display region capable of presenting the information signal to a viewer. The display region may be centered in the projected image while around it the remaining part of the projection area is utilized by a backlighting effect, comprising at least two illumination areas having different reaction time depending on their position within the projected image. In this embodiment the outer areas may still be generated differently from the areas closer to the projected display region.

In an embodiment the illumination area comprises three LEDs of the colors red, green and blue. By varying the input current to each LED a light spectrum of visible colors corresponding to the RGB color space may be presented. If the illumination source requires an RGB input signal or any other combined luminance and chrominance signal, accordingly the second conversion unit is adapted to create a second signal comprising the required format of luminance and chrominance components, and in the case of RGB the resulting second signal will comprise one R, G, and B component.

In an embodiment display device and illumination area may be comprised in a LED video screen, such as a vidiwall. The LED video screen comprises a display region capable of presenting the information signal to a viewer. The display region may be centered in the LED video screen while around it the remaining part of the LED video screen area is configured to provide a backlighting effect, comprising at least two illumination areas having different reaction time depending on their position within the LED video screen. In this embodiment the outer areas of the LED video screen may still be generated differently from the areas closer to the display region.

Illumination sources other than LEDs are equally possible within the scope of the invention. Hence, the use of the term LED in this context should be appreciated as a light emitting system that is capable of receiving an electric signal and producing a color of light in response to the signal, e.g. light emitting polymers, semiconductor dies that produce light in response to current, organic LEDs, electro-luminescent strips, silicon based structures that emit light, and other such systems.

In an embodiment the illumination area comprises an illumination source for emitting light based on the information signal. The illumination source may be incandescent sources such as filament lamps, photo-luminescent sources such as gaseous discharges, fluorescent sources, phosphorescence sources, lasers, electro-luminescent sources such as luminescent lamps, cathode luminescent sources using electronic satiation, luminescent sources including galvano-luminescent sources, crystallo-luminescent sources, kine-luminscent sources, thermo-luminescent sources, tribo-luminescent sources, sono-luminescent sources and radio-luminescent sources.

In an embodiment the light radiation chrominance and luminance that each illumination area emit depends on the position of the illumination area within the display system and the chrominance and luminance information of the second signal.

Figure 2:
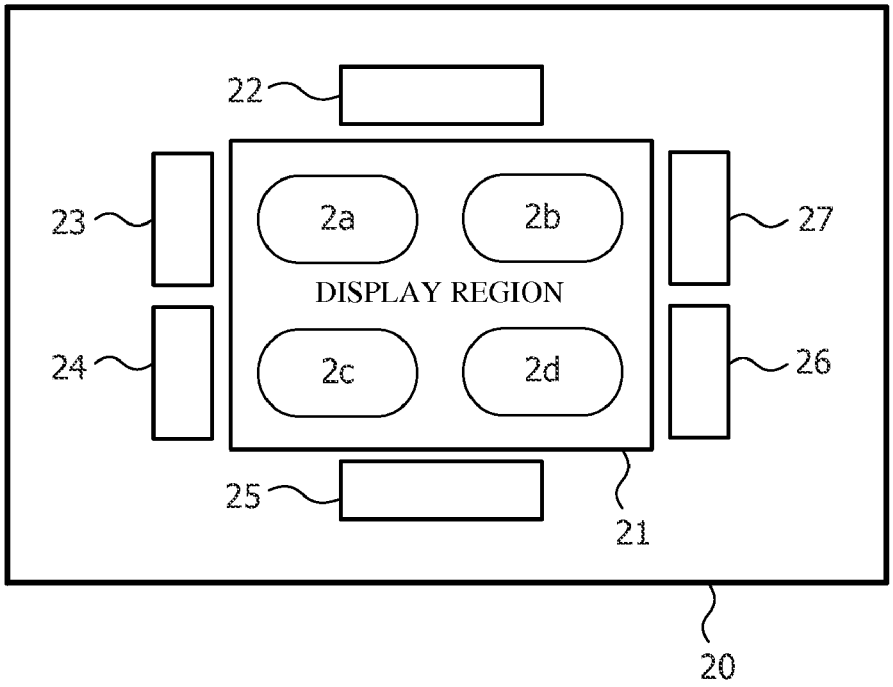
FIG. 2 is an illustration showing a display system according to an embodiment.

FIG. 2 shows illustratively a practical implementation of the system according to some embodiments. The system comprises a display region 21 having four monitoring regions 2*a*, 2*b*, 2*c*, 2*d* defined therein, each monitoring region being connected to at least one illumination area, indicated as 22, 23, 24, 25, 26, 27. The monitoring regions thus constitute a part(s) of the information signal. The display region is capable of presenting the information signal to a user, and hence the image information of the monitoring regions is comprised in the information signal. Each illumination area is via a control unit and monitor unit, such as an electric drive circuit, connected to at least one monitoring region according to the following Table 1.

TABLE 1

| Illumination area | Monitoring region |
|---|---|
| 22 | 2a and 2b |
| 23 | 2a |
| 24 | 2c |

TABLE 1-continued

| Illumination area | Monitoring region |
|---|---|
| 25 | 2c and 2d |
| 26 | 2d |
| 27 | 2b |

As may be observed in Table 1, illumination area 22 is connected to the chrominance and luminance information of monitoring region 2*a* and 2*b*. Similarly, illumination area 25 is connected to the luminance and chrominance information of monitoring segment 2*c* and 2*d*. The illumination areas 23, 24, 26, and 27 correspond to monitoring regions 2*a*, 2*c*, 2*d*, and, 2*b*, respectively.

If a monitoring region contains predominantly green colors at a point in time, the first signal from the monitor unit will comprise information to emit a green color and so forth. The monitor unit that via the control unit is connected to the illumination areas is responsive to chrominance and luminance information presented in the monitoring regions, i.e. the information signal, and produce first signals which are fed into the first conversion unit for further processing.

The first signal may in addition to luminance and chrominance information comprised in the information signal comprise information regarding the monitoring regions, such as number, position and size of the monitoring regions.

In some embodiments the first signal is identical to the information signal.

If the first signal comprises image information based on the RGB color space the first conversion unit converts the first signal from the RGB color space to the separate luminance information component and separate chrominance information component, such as corresponding to the YUV color space, and the control unit controls the reaction time separately depending on the separate luminance and chrominance components.

Monitor Unit

In an embodiment the monitor unit comprises a chrominance and luminance detector, such as a peak detector, average color detector etc. to provide the first signal.

In an embodiment the monitoring region is used to drive multiple illumination areas.

In an embodiment any combination of monitoring region to illumination area is possible. A common feature for all combinations is that the control unit utilizes different settings of the reaction time or integration time, for different illumination areas depending on the luminance and chrominance components of the first signal, and/or the relative position of this area to the display region.

Control Unit

The control unit is capable of controlling the light radiation of the illumination areas of the display system. It continuously receives first signals from the monitor unit regarding the color and luminance of each illumination area via the first conversion unit and may use this information together with other criteria in order to control the light radiation chrominance and luminance of the illumination areas.

The control unit may utilize different reaction times, i.e. integration times, for each illumination area of the display system. Moreover, the control unit may utilize two different reaction times for each illumination area simultaneously, by utilizing one reaction time for the Y component of the first signal and one reaction time for the UV component of the first signal for each illumination area simultaneously.

As the illumination area input signal mostly requires input parameters according to the RGB color space, the second conversion unit is capable of converting the processed (i.e. integrated using different integration/reaction times) separated luminance, e.g. Y, and chrominance, e.g. UV, components of the first signal to a second signal functioning as the illumination area input signal, continuously comprising the converted RGB parameters for each illumination area for each point in time.

Reaction Times

As an example, the reaction time for the luminance, such as Y, component for a specific illumination area is defined as 60 frames, meaning 1 s for a 60 Hz information signal. The reaction time for the chrominance, such as UV, component may be defined as 4 frames, meaning 67 ms for a 60 Hz information signal. This reaction time setup implies that the Y component is integrated 15 times longer than the UV component. As an example, if the UV component of the first signal changes from one value to another and then stays constant, it takes 4 frames until the UV component in the second signal is also finished changing to this new value; however the change is performed gradually as both the chrominance and luminance information components are continuously integrated, based on their different reaction times. This means that every frame only a fraction of the Y component contributes to the second signal and after 15 frames these fractions added together equal one. Thus, provided that the Y component changes from one value to another at a certain point in time and then stays equal for at least 15 frames, after 15 frames the second signal has gradually changed from the original Y component to the new one. Similar for the UV component, only a fraction of the UV component contributes to the second signal and after 4 frames these fractions added together equal one. For a linear system every frame after the change in the first signal the UV in the second signal would change with $\Delta UV/4$.

Figure 3:
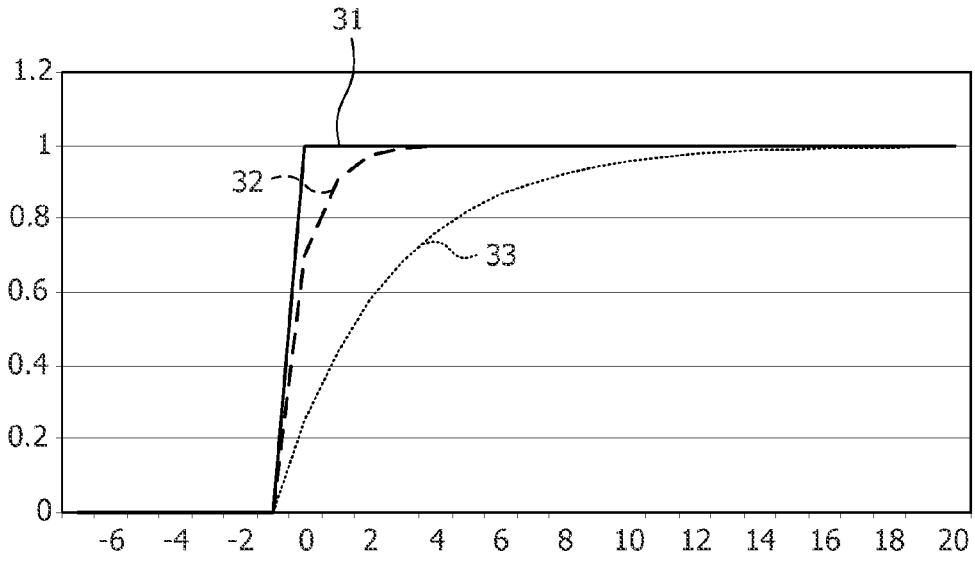
FIG. 3 is a timing diagram according to an embodiment.

An example of a non-linear system, meaning that the integration of the luminance and chrominance information components is performed in a non-linear manner, is illustrated in FIG. 3. In FIG. 3 the x-axis corresponds to time and the y-axis to relative intensity. In FIG. 3, the first signal 31, comprising both luminance and chrominance information, changes suddenly. The integrated chrominance information component 32, such as UV, would change e.g. according to an asymptotic function, based on the second reaction time, and after 4 frames it is approximately at the final value while the luminance information component 33, such as Y, changes according to another asymptotic function, based on the first reaction time, and thus it takes about 15 frames in this example until the integrated luminance information component is at the final value. If the first signal is not stable, e.g. for the total 15 frames in the example above, the chrominance component 32 follows quickly and the luminance component 33 follows more slowly. This provides the desired enhanced viewing experience by having the backlighting colors better adapted to the screen content while at the same time also having a relaxed viewing experience because the brightness slowly changes over time.

However, other reaction time setups are equally possible, such as 120 frames for the luminance component, or 8 frames for the chrominance component, etc.

In an embodiment the second signal at every point in time comprises a summation of the latest converted contributions for both the Y and UV components. In the example above, during the starting 15 frames during which the Y components are integrated, no Y-information is available.

In an embodiment the control unit controls the reaction time of each illumination area depending on each illumination area position within the display system and the RGB to YUV conversion of the first signal from the monitor unit. In this way the different illumination areas react temporally different to the first signal from the monitor unit.

In an embodiment the luminance value, e.g. Y, is integrated using a low rise and fall time (slow changes) while the chrominance values, such as UV, are integrated using high rise and fall times (fast responding to changes). The resulting color is converted back to RGB for further processing.

Conversion Unit

In an embodiment the first conversion unit is configured from conversion between the RGB color space and the YUV color space.

In an embodiment the second conversion unit is configured from conversion between the YUV color space and the RGB color space.

In an embodiment the first conversion unit and second conversion unit are comprised into one conversion unit.

In an embodiment the first conversion unit utilizes the following equation:

$$Y=0.299R+0.587G+0.114B$$

$$U=0.436(B-Y)/(1-0.114)$$

$$V=0.615(R-Y)/(1-0.299)$$

First, the weighted values of R, G and B are added together to produce a single Y signal, representing the overall luminance for the corresponding monitoring region of the information signal. The U signal is subsequently created by subtracting Y from the blue signal of the original RGB information signal, followed by scaling. Similarly, V is created by subtracting Y from the red, followed by scaling with a different factor. This may be accomplished easily with analog circuitry.

In an embodiment the second conversion unit utilizes the following equation:

$$R=Y+1.139837398373983740V$$

$$G=Y-0.394651704358970351 5U-0.580598606667497680 1V$$

$$B=Y+2.032110091743119266U$$

In an embodiment at least two of: the monitor unit, first conversion unit, second conversion unit, and control unit are comprised in one integrated unit.

The monitor unit, first and second conversion unit, and control unit may be any unit normally used for performing the involved tasks, e.g. a hardware, such as a processor with a memory. The processor may be any of variety of processors, such as Intel or AMD processors, CPUs, microprocessors, Programmable Intelligent Computer (PIC) microcontrollers, Digital Signal Processors (DSP), etc. However, the scope of the invention is not limited to these specific processors. The memory may be any memory capable of storing information, such as Random Access Memories (RAM) such as, Double Density RAM (DDR, DDR2), Single Density RAM (SDRAM), Static RAM (SRAM), Dynamic RAM (DRAM), Video RAM (VRAM), etc. The memory may also be a FLASH memory such as a USB, Compact Flash, SmartMedia, MMC memory, MemoryStick, SD Card, MiniSD, MicroSD, xD Card, TransFlash, and MicroDrive memory etc. However, the scope of the invention is not limited to these specific memories.

Figure 4:
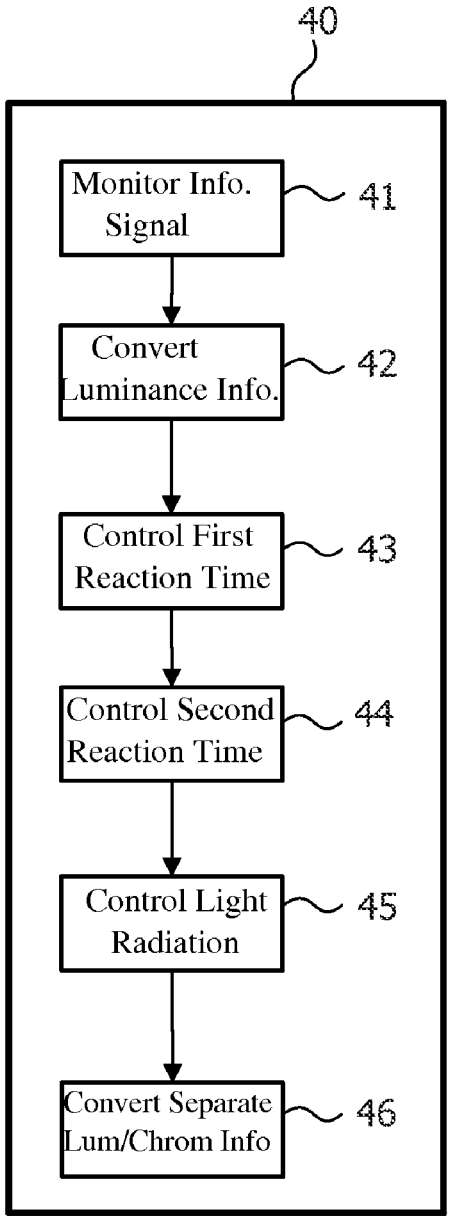
FIG. 4 is a flow diagram of a method according to an embodiment.

In an embodiment, according to FIG. 4, a method is provided. The method comprises monitoring 41 an information signal comprising luminance and chrominance information, and generating a first signal. Moreover, the method comprises converting 42 the luminance information of the first signal to a separate luminance information component, and chrominance information of the first signal to a separate chrominance information component. Furthermore, the method comprises controlling 43 a first reaction time of an illumination area, the illumination area being capable of emitting light radiation, wherein the first reaction time is defined for the separate luminance information component. The method also may comprise controlling 44 a second reaction time of the illumination area, wherein the second reaction time is defined for the separate chrominance information component. Moreover, the method comprises controlling 45 light radiation emitted from each illumination area in response to the luminance information component and the first reaction time, and the chrominance information and the second reaction time.

In an embodiment the method moreover comprises converting 46 the separate luminance information component for each illumination area based on the first reaction time, and the separate chrominance information component for the illumination area on the second reaction time to combined chrominance and luminance information, generating a second signal, and wherein the controlling 45 involves controlling light radiation emitted from the illumination area in response to the second signal.

Figure 5:
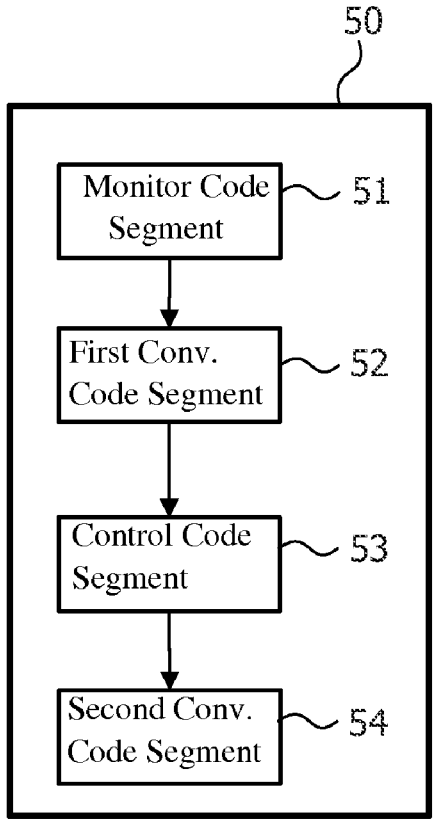
FIG. 5 is a block diagram of a computer-readable medium according to an embodiment.

In an embodiment, according to FIG. 5, a computer-readable medium 50 having embodied thereon a computer program for processing by a processor is provided. The computer program comprises a monitor code segment 51 configured to monitor an information signal comprising luminance and chrominance information, and generate a first signal. The computer program further comprises a conversion code segment 52 configured to convert the luminance information of the first signal to a separate luminance information component, and chrominance information of the first signal to a separate chrominance information component. Moreover, the computer program comprises a control code segment 53 configured to control a first reaction time of an illumination area, the illumination area being capable of emitting light radiation, wherein the first reaction time is defined for the separate luminance information component. The control code segment 53 may also be configured to control a second reaction time of the illumination area, wherein the second reaction time is defined for the separate chrominance information component. Furthermore, the control segment 53 may be configured to control light radiation emitted from each illumination area in response to the luminance information component and the first reaction time, and the chrominance information and the second reaction time.

In an embodiment the computer-readable medium further comprises a second conversion code segment 54 for converting the separate luminance information component for each illumination area based on the first reaction time, and the separate chrominance information component for each illumination area on the second reaction time to combined luminance and chrominance information, generating a third signal, and wherein the control segment 53 further is configured to control light radiation emitted from each illumination area in response to the third signal.

Applications and use of the above-described embodiments according to the invention are various and include all cases, in which backlighting is desired, and may accordingly be used in all backlighting systems based upon video information.

The invention may be implemented in any suitable form including hardware, software, firmware or any combination of these. However, preferably, the invention is implemented as computer software running on one or more data processors and/or digital signal processors. The elements and components of an embodiment of the invention may be physically, functionally and logically implemented in any suitable way. Indeed, the functionality may be implemented in a single unit, in a plurality of units or as part of other functional units. As such, the invention may be implemented in a single unit, or may be physically and functionally distributed between different units and processors.

Although the present invention has been described above with reference to specific embodiments, it is not intended to be limited to the specific form set forth herein. Rather, the invention is limited only by the accompanying claims and, other embodiments than the specific above are equally possible within the scope of these appended claims.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A display system for complementing a changing image produced on a display region comprising:

a monitor unit configured to monitor an information signal comprising luminance and chrominance information representative of at least a part of said changing image and to generate a first signal based on said luminance and chrominance information;

a first conversion unit configured to convert said luminance and chrominance information of said first signal to a separate luminance information component and a separate chrominance information component, respectively; and a control unit configured to control:

control, at a first reaction time, changes in brightness of light radiation emanating from at least one illumination area disposed adjacent the display region in response to changes in said separate luminance information component;

control, at a second reaction time, changes in color of light radiation emanating from said at least one illumination area in response to changes in said separate chrominance information component;

said first reaction time and said second reaction time being controlled separately to adjust the visual affect of said light radiation.

2. The display system according to claim 1 where the first reaction time of said light radiation corresponds to integration of said luminance information component over time and said second reaction time of said light radiation corresponds to integration of said chrominance information component over time.

3. The display system according to claim 1 comprising a second conversion unit configured to convert said luminance information component and said chrominance information component, to combined luminance and chrominance information and to generate a second signal representative of said combined luminance and chrominance information, said control unit being configured to control the light radiation emanating from said at least one illumination area in response to said second signal.

4. The display system according to claim 1 where said monitor unit monitors said changing image on at least one monitoring region of the display region, said first signal being based on luminance and chrominance information representative of said changing image on said at least one monitoring region.

5. The display system according to claim 1 where said first reaction time is larger than said second reaction time.

6. The display system according to claim 1 where said information signal comprises an image or video signal.

7. The display system according to claim 1 where said information signal comprises a RGB signal corresponding to the RGB color space.

8. The display system according to claim 1 where said first signal comprises a YUV signal.

9. The display system according to claim 1 where said separate luminance information component and said separate chrominance information component comprise a luminance component and a chrominance component, respectively, in the YUV color space, Yu'v' color space, or Yxy color space.

10. The display system according to claim 1 where said first reaction time comprises a duration of 60-120 frames and said second reaction time comprises a duration of at least 4 frames.

11. The display system according to claim 1 where said display region comprises part of a display device.

12. The display system according to claim 1 where said display region comprises a surface on which the changing image is produced by a projector.

13. A method for complementing a changing image produced on a display region comprising:

monitoring an information signal comprising luminance and chrominance information; representative of at least a part of said changing image;

converting said luminance information to a separate luminance information component and said chrominance information to a separate chrominance information component;

controlling, at a first reaction time, changes in brightness of light radiation emanating from at least one illumination area disposed adjacent the display region in response to changes in said separate luminance information component;

controlling, at a second reaction time, changes in color of light radiation emanating from said at least one illumination area in response to said separate chrominance information component;

said first reaction time and said second reaction time being controlled separately to adjust the visual affect of said light radiation.

14. The method according to claim 13 comprising converting said luminance information component and said chrominance information component to combined luminance and chrominance information, generating a signal representative of said combined luminance and chrominance information, and controlling the light radiation emitted from said at least one illumination area in response to said signal.

15. A non-transitory computer-readable medium having embodied thereon a computer program for processing by a processor to effect the complementing of a changing image produced on a display region, said computer program comprising:

a monitor code segment configured to monitor an information signal comprising luminance and chrominance information representative of at least part of said changing image and to generate a first signal based on said luminance and chrominance information;

a first conversion code segment configured to convert said luminance and chrominance information of said first signal to a separate luminance information component and a separate chrominance information component, respectively; and a control code segment configured to:

control, at a first reaction time, changes in brightness of light radiation emanating from at least one illumination area disposed adjacent the display region in response to said separate luminance information component, control, at a second reaction time, changes in color of light radiation emanating from said at least one illumination area in response to changes in, said separate chrominance information component;

said first reaction time and said second reaction time being controlled separately to adjust the visual affect of said light radiation.

16. The computer-readable medium according to claim 15, said computer program comprising a second conversion code segment configured to convert said luminance information component and said chrominance information component, to combined luminance and chrominance information and to generate a second signal representative of said combined luminance and chrominance information, said control code segment being configured to control the light radiation emanating from said at least one illumination area in response to said second signal.

* * * * *